US007034219B2

(12) United States Patent
Koo

(10) Patent No.: US 7,034,219 B2
(45) Date of Patent: Apr. 25, 2006

(54) KEYBOARD AND METHOD FOR MANUFACTURING THE SAME

(76) Inventor: Jung-O Koo, 104-1701, Hangook Apt.,179-1, Galsan-dong, Boopyung-ku, Incheon-city, 403-704 (KR)

( * ) Notice: Subject to any disclaimer, the term of this patent is extended or adjusted under 35 U.S.C. 154(b) by 200 days.

(21) Appl. No.: 10/687,173

(22) Filed: Oct. 16, 2003

(65) Prior Publication Data

US 2004/0159226 A1 Aug. 19, 2004

(30) Foreign Application Priority Data

Feb. 10, 2003 (KR) ..... 10-2003-08281

(51) Int. Cl.
*G10H 1/34* (2006.01)

(52) U.S. Cl. ..... 84/745; 84/719

(58) Field of Classification Search ..... 84/719, 84/744, 745, 326, 423 R, 424, 428, 466–468, 84/451, 478, 479 R; 200/5 A; 248/118; 428/195.1
See application file for complete search history.

(56) References Cited

U.S. PATENT DOCUMENTS 3,979,568 A * 9/1976 Johnson ..... 200/5 A
4,491,702 A * 1/1985 Kato ..... 200/5 A
4,636,593 A * 1/1987 Novak et al. ..... 200/5 A
5,374,018 A * 12/1994 Daneshvar ..... 248/118
6,087,575 A * 7/2000 Niitsuma ..... 84/423 R
6,322,875 B1 * 11/2001 Kimura ..... 428/195.1

* cited by examiner

*Primary Examiner*—David Martin
*Assistant Examiner*—Jianchun Qin
(74) *Attorney, Agent, or Firm*—Dilworth & Barrese LLP

(57) ABSTRACT

A keyboard and a method for manufacturing the keyboard using silicon rubber. The method for manufacturing the keyboard includes forming sheets from silicon rubber; forming the sheets into a top pad with keys integrally formed thereon and a bottom pad bonded to a bottom surface of the top pad; painting the keys through a silk-screen printing method; and bonding the top and bottom pads with silicon liquid rubber in a state where a flexible printed circuit board is interposed between the pads. The keyboard is configured such that the painted keys are arranged on a top surface of the top pad and the flexible printed circuit board is interposed between the top and bottom pads so that the flexible printed circuit board is electrically contacted to produce a desired sound from a speaker of a controller when a user strikes the keys.

10 Claims, 5 Drawing Sheets

KEYBOARD AND METHOD FOR MANUFACTURING THE SAME

PRIORITY

This application claims priority to an application entitled "KEYBOARD AND METHOD FOR MANUFACTURING THE SAME" filed in the Korean Industrial Property Office on Feb. 10, 2003 and assigned 10-2003-8281, the contents of which are hereby incorporated by reference.

BACKGROUND OF THE INVENTION

1. Field of the Invention

The present invention relates to a method for manufacturing a keyboard for keyboard instruments. More particularly, the present invention relates to a method for manufacturing a keyboard which is manufactured in the form of a thin plate pad made of silicon rubber so that it can function as a keyboard, and a keyboard manufactured by the method.

2. Description of the Related Art

In case of keyboard instruments such as a piano, a user generally strikes white or black keys with his/her fingers and causes strings to vibrate so that music can be played. To this end, the keyboard is manufactured in such a manner that the keys are separately operated.

The conventional keys have been generally made from an ivory of elephants, however, the keys are recently formed by shaving a piece of wood into a key shape and painting the keys with black or white colors so as to indicate and distinguish white and black keys.

However, since the piano itself as well as the keyboard is generally made of very thick wood, it is too heavy for man to carry the piano. Therefore, the mobility thereof is considerably restricted. Further, since the volume of the piano is greatly large, there is inconvenience in that a relatively large space is required for storing the piano.

Accordingly, in order to reduce weight of musical instruments than that of the conventional piano and allow sounds of string or percussion instruments other than the piano to be produced, digital keyboard instruments have been recently developed.

In the digital keyboard instruments, sensors for detecting which keys are struck by the user are installed below the keyboard so that the set digital sounds corresponding to the detected keys can be produced. The weight of the digital keyboard instruments has been greatly reduced as compared with the conventional wooden piano, and the mobility and storage capability are considerably enhanced.

Notwithstanding, the digital keyboard instrument has been configured in such a manner that a plurality of keys which are basically operated separately are positioned at an upper portion of the instrument and a support frame for the keys is installed at a lower portion thereof. Therefore, there is a problem in that it is difficult to carry and move the digital keyboard instruments.

Further, although the electronics industry has been remarkably developed, a study on miniaturization and reduction of weight of the controller unit for producing the digital sound makes little progress. Therefore, there is still another problem in that the controller unit as well as the keyboard causes the weight of the keyboard instruments to be remarkably increased.

To overcome the above problems, there is a tendency to reduce the weight of the digital instruments by forming the keyboard out of plastics. However, since there is no resiliency in the plastic keys when a user strikes the keys with his/her finger, an excessive load is apt to be applied to the user's finger joints. Therefore, the keyboard instruments of this kind are manufactured as the playing tools for children rather than the performance instrument.

Accordingly, there is a need to manufacture the keyboard which is very light and small in order to enhance the mobility and storage capability of the keyboard instruments and is suitable for playing the instruments for a long time because an excessive load is not applied to the fingers due to a certain degree of elasticity.

SUMMARY OF THE INVENTION

Therefore, the present invention is conceived to solve the aforementioned problems in the prior art. A primary object of the present invention is to provide a keyboard and a method of manufacturing the same wherein keyboard instruments can be easily stored and carried by manufacturing a keyboard in the form of a pad using silicon rubber.

A secondary object of the present invention is to provide a method of manufacturing a keyboard wherein the keyboard can be rapidly produced in a large quantity through press works and painting works using a printing machine.

According to an aspect of the present invention for achieving the objects, there is provided a method for manufacturing a keyboard, which comprises the steps of coloring gel-state silicon rubber by mixing pigments with the silicon rubber; rolling the colored silicon rubber into a plurality of sheets with a prescribed thickness; forming a top pad by press working the sheet such that a plurality of keys are arranged on a top surface of the top pad and a plurality of recesses are formed on a bottom surface thereof to correspond to the keys in view of their shapes and locations; forming a bottom pad by press working the sheet such that the bottom pad has a shape corresponding to the bottom surface of the top pad and a width of the bottom pad is further increased; painting surfaces of the keys through a silk-screen printing method; heating the painted top pad at a temperature of 180° C. for 10 minutes and drying ink painted on the top pad; and aligning the bottom pad and a flexible printed circuit board with electrical contact portions formed thereon corresponding to the recesses with respect to the bottom surface of the top pad and bonding corresponding edges of the top and bottoms pads to finish the keyboard.

Preferably, the step for forming the bottom pad comprises the step of forming escape prevention jaws having a relatively narrow width and long length in a longitudinal direction along portions extending widthwise further than the top pad.

Preferably, silicon liquid rubber is used as an adhesive in the bonding step.

Preferably, the step for forming the top pad may comprise the step of forming a first engaging jaw by upward bending and horizontally extending a first end of the top pad.

More preferably, the step for forming the bottom pad comprises the step of forming a second engaging jaw by upward bending and horizontally extending a first end of the bottom pad such that the second engaging jaw is brought into close contact with a bottom surface of the first combining jaw.

Further, the step for forming the top pad may comprise the step of forming a first fitting portion, which grows thicker toward an outermost end, on a second end of the top pad.

Furthermore, the step for forming the bottom pad may comprise the step of forming a second fitting portion, which corresponds to the first fitting portion and protrudes downward in a certain length along a lateral direction, at a second end on a bottom surface of the bottom pad.

According to another aspect of the present invention, there is provided a keyboard, comprising a top pad with a plurality of first keys and second keys integrally formed and arranged on a top surface thereof; a bottom pad of which width is relatively extended and of which top surface corresponds to a bottom surface of the top pad in view of their shapes such that edges of the top and bottom pads are bonded to each other; and a flexible printed circuit board which is interposed between the top and bottom pads, sealed therebetween by bonding the edges of the top and bottom pads, and formed with contact portions corresponding to the keys, wherein first and second recesses are formed on the bottom surface of the top pad to correspond to the first and second keys and the contact portions of the flexible printed circuit board in view of their shapes and locations, and the top and bottom pads and the keys are made from silicon rubber material and are colored with pigments and painted with inks to give predetermined colors to the pads.

Preferably, the bottom pad includes escape prevention jaws formed along extended portions of the bottom pad in a longitudinal direction to have a relatively narrow width and long length.

Preferably, the top pad includes a first engaging jaw formed by upward bending and horizontally extending a first end thereof.

Preferably, the bottom pad includes a second engaging jaw formed by upward bending and horizontally extending a first end thereof to come into close contact with a bottom surface of the first combining jaw.

Preferably, the top pad includes a first fitting portion, which grows thicker toward an outermost end, on a second end thereof.

Further, the bottom pad may include a second fitting portion, which corresponds to the first fitting portion and protrudes downward in a certain thickness along a lateral direction, at a second end on a bottom surface thereof.

Furthermore, the top and bottom pads may be bonded to each other using silicon liquid rubber as an adhesive.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

Hereinafter, a method for manufacturing a keyboard according to the present invention will be described in detail with reference to the accompanying drawings.

Figure 1:
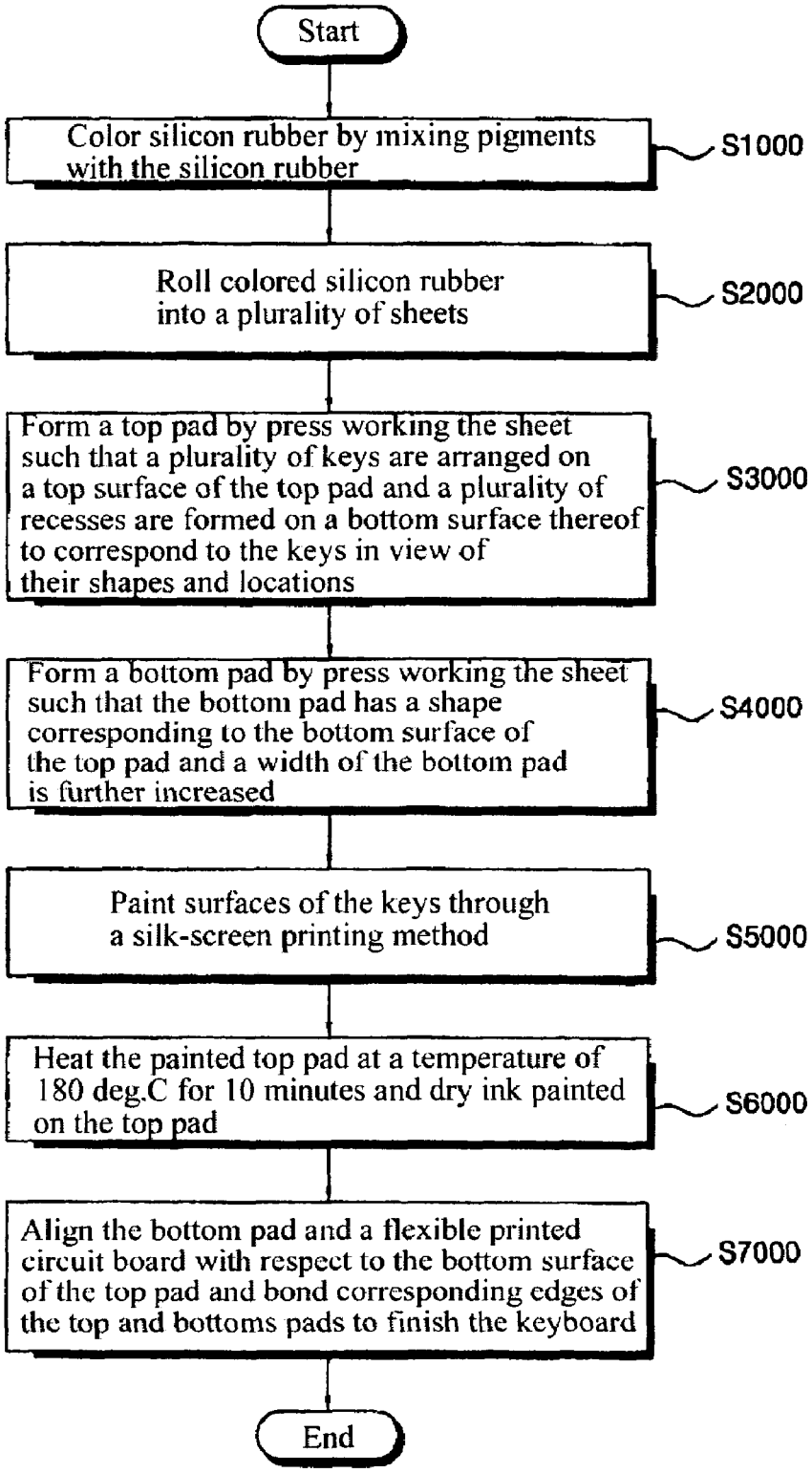
FIG. 1 is a flowchart illustrating a method for manufacturing a keyboard according to the present invention.
Figure 2:
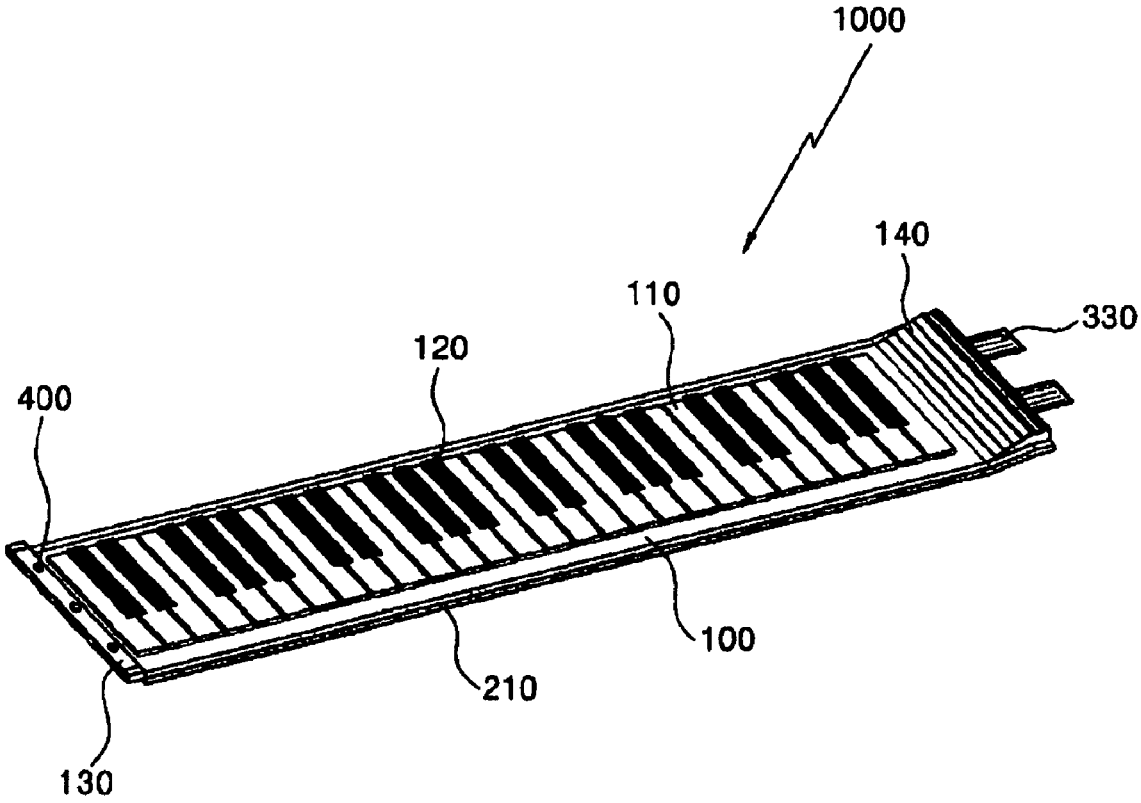
FIG. 2 is a perspective view of the keyboard so manufactured according to the present invention.
Figure 3:
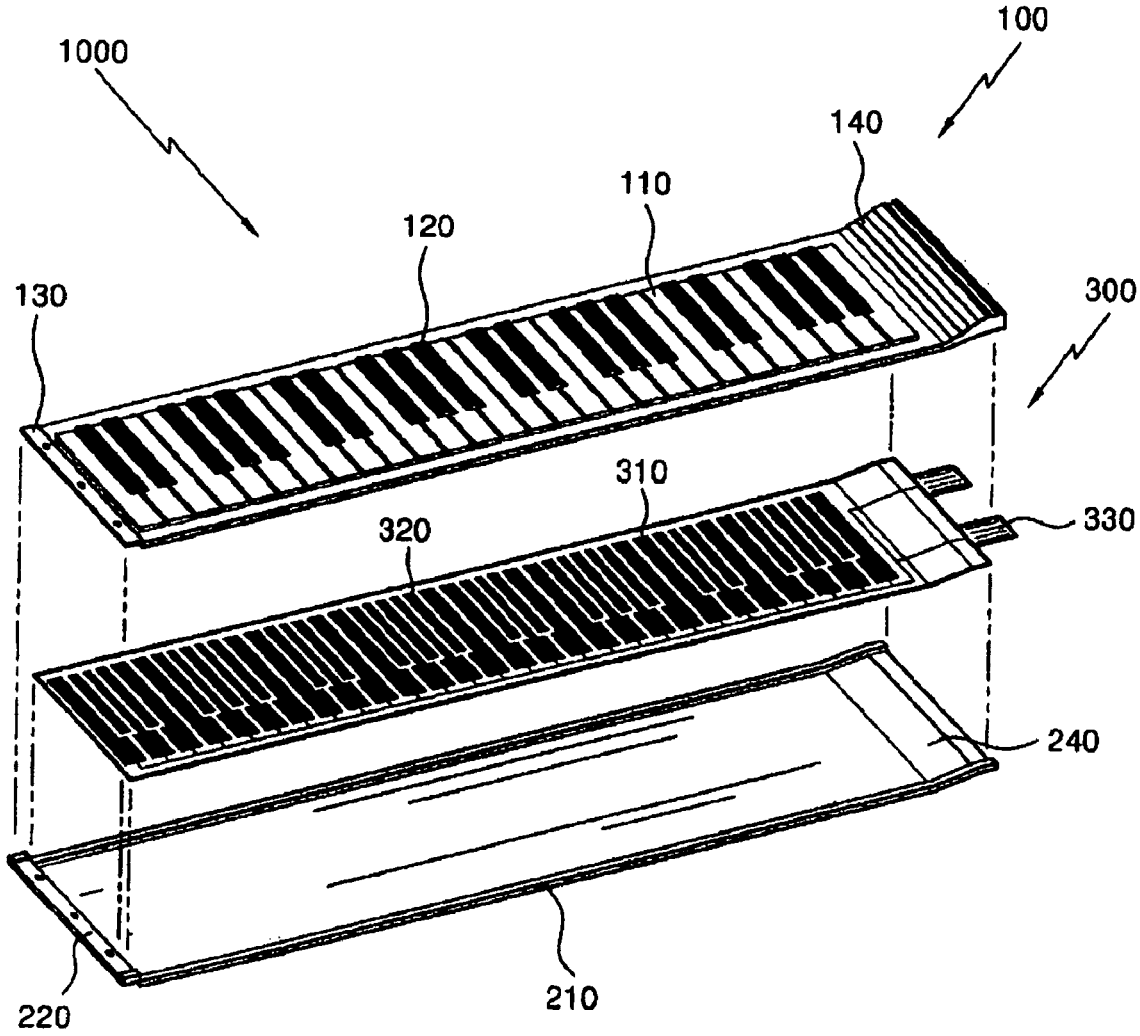
FIG. 3 is an exploded perspective view of the keyboard so manufactured according to the present invention.

FIG. 1 is a flowchart illustrating a method for manufacturing a keyboard according to the present invention; FIG. 2 is a perspective view of the keyboard so manufactured according to the present invention; FIG. 3 is an exploded perspective view of the keyboard so manufactured according to the present invention; and FIG. 4 is another exploded perspective view of the keyboard so manufactured according to the present invention.

Figure 4:
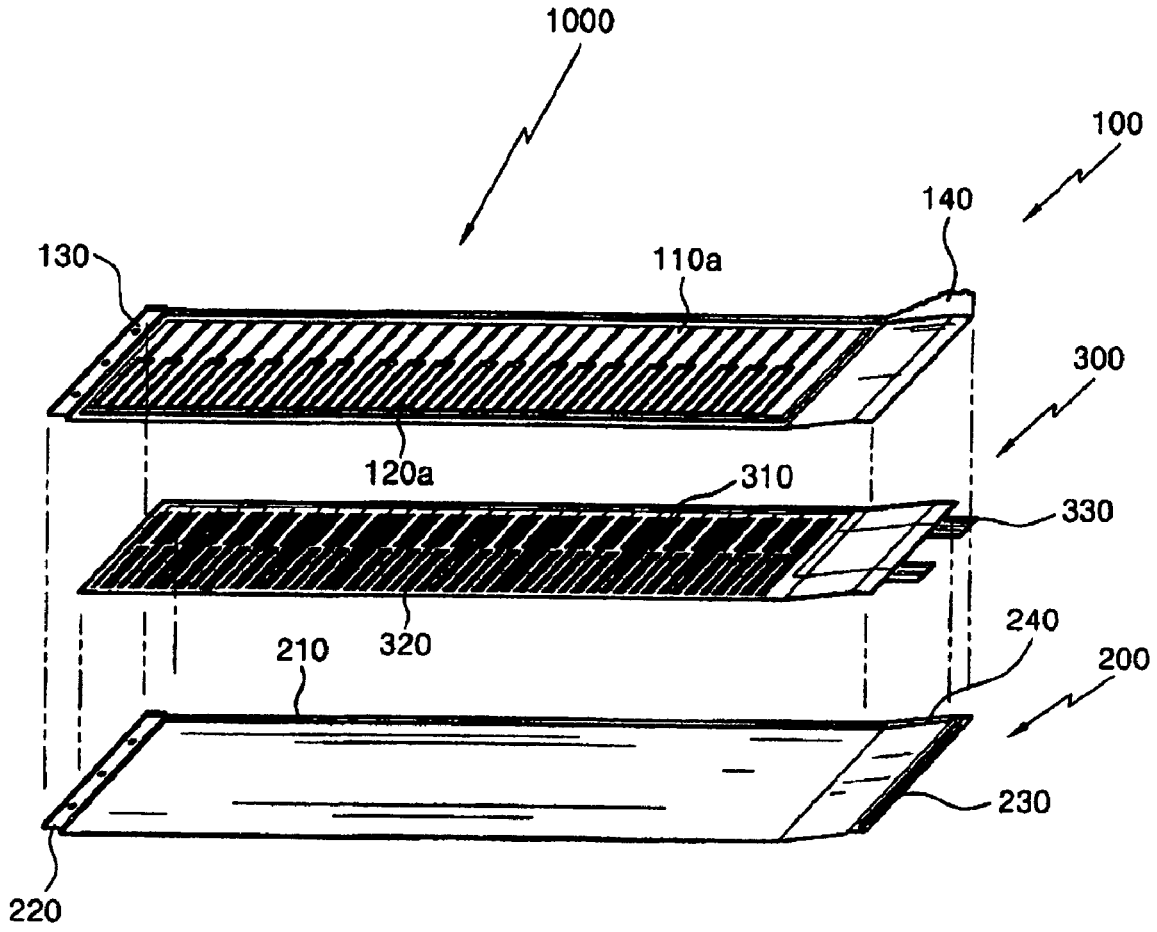
FIG. 4 is another exploded perspective view of the keyboard so manufactured according to the present invention.

Referring to FIGS. 2 to 4, a keyboard 1000 is manufactured by press forming a thin sheet made from flexible silicon rubber into a keyboard shape. More specifically, two sheets are first prepared, one of the two sheets is formed into a top pad 100 in the form of a keyboard, and the other is formed into a bottom pad 200 that is bonded to the top pad 100.

Then, a flexible printed circuit board 300 is securely positioned between the top and bottom pads 100 and 200, and corresponding edges of the pads 100 and 200 are bonded to each other. Consequently, the keyboard 1000 is finished.

Herein, the sheet is formed to have a predetermined color by mixing silicon rubber, which is in a gel state, with pigments with the predetermined color. At this time, a hardening accelerator is also put in the silicon rubber together with the pigments. An amount of the pigments and accelerator is very small such that a ratio of the amount of the pigments and accelerator to the silicon rubber is approximately 1/1,000 to 1/10,000. Thus, the sheet is colored and cured during the mixing process (S1000).

Before the sheet is completely cured, the colored silicon rubber is rolled to form a sheet with a predetermined thickness. Thus, a number of the sheets are manufactured and prepared (S2000).

One of the sheets prepared as such is positioned and pressed onto a metal mold for forming the top pad 100 so that the rectangular top pad 100 of which a length is greater than a width is formed. Then, edge portions protruding from an edge of the mold are cut and trimmed.

Thereafter, a plurality of first keys 110 and second keys 120 with a length shorter than that of the first keys are formed and arranged on a top surface of the top pad 100. Further, a plurality of first and second recesses 110*a* and 120*a* are formed at locations corresponding to the first and second keys 110 and 120 on a bottom surface of the top pad 100 so that they have the same shape as the corresponding the first and second keys 110 and 120. That is, if the top surface of top pad 100 is embossed with the keys 110 and 120, the bottom surface of top pad 100 is engraved correspondingly with the recesses 110*a* and 120*a*. Therefore, when the keys 110 and 120 are struck in a state where they are used in the final product, the keys can be deeply depressed through the recesses 110*a* and 120*a* formed at the locations corresponding to the keys.

A first fitting portion 140 with a thickness growing thicker toward an outermost end is formed at a second side of the top pad 100 (a right side in FIG. 3). A top surface of the first fitting portion 140 is shaped as a stair structure in which a surface is raised toward the outermost end, whereas a bottom surface thereof is formed such that it inclines upward and then extends horizontally.

Furthermore, a first engaging jaw 130 that is bent upward and then extended horizontally is formed at a first side of the top pad 100 (a left side in FIG. 3). A plurality of through-holes are formed in the first engaging jaw 130 along a lateral direction at a regular interval. Therefore, the rectangular top pad 100 is generally formed in such a manner that the first engaging jaw 130 and the first fitting portion 140 are formed at both sides, respectively, and the plurality of first and second keys 110 and 120 are arranged and formed between them in a longitudinal direction (S3000).

The other sheet is positioned and pressed onto the press mold for forming the bottom pad 200. The bottom pad 200 has the same length as the top pad 100 but a width greater than that of the top pad 100. The bottom pad 200 is formed such that its top surface corresponds to the bottom surface of the top pad 100 as a whole. Then, edge portions of the bottom pad protruding from an edge of the mold are cut and trimmed after the forming process has been finished.

Escape prevention jaws 210 with a narrow width and long length are formed along the extended width portions of the bottom pad 200. When the top pad 100 is placed onto the bottom pad 200, the former is fully and snugly seated between the escape prevention jaws 210 on the bottom pad 200. Further, a second fitting portion 230 that is extended downward along a width direction is formed on a bottom surface at a second side of the bottom pad 200 (right side in FIG. 4) so as to correspond to the first fitting portion 140. In addition, an inclined portion 240 that inclines upward and then extends horizontally is formed on a top surface of the second side of the bottom pad 200 since the second fitting portion 230 has been formed to extend downward. The inclined portion 240 comes into close contact with the bottom surface of the first fitting portion 140.

Therefore, since the inclined portion 240 of the bottom pad 200 comes into contact with the bottom surface of the first fitting portion 140 of the top pad 100 and the second fitting 230 is formed on the bottom surface of the inclined portion 240, one side of the engaged top and bottom pads 100 and 200 is further thick. This is because the first and second fitting portions 140 and 230 can be fixed to a box-shaped controller 2000 (refer to FIG. 5) in which the one side of the keyboard 1000 is included.

Further, a second engaging jaw 220 is formed at a first side of the bottom pad 200, and it is also bent upward and extended horizontally to come into contact with the first engaging jaw 130 of the top pad 100. A plurality of through-holes are also formed in the second engaging jaw 220 at a regular interval to correspond to the through-holes of the first engaging jaw 130 (S4000).

After forming the top and bottom pads 100 and 200 as described above, the top pad 100 is mounted on a silk-screen printing machine to paint the keys 110 and 120 thereon. At this time, the first keys 110 whose length is relatively long are pained with white ink, whereas the second keys 120 whose length is relatively short are pained with black ink. The painting process is performed twice, i.e., by first painting the second keys 120 with black ink whose brightness is low and then painting the first keys 110 with white ink whose brightness is high (S5000).

Then, the painted top pad 100 is introduced into a drying furnace, heated at a temperature of about 170° C. to 190° C. and then dried for 10 minutes, so that the painted ink is completely dried. At this time, in order to dry the painted ink without deformation in the top pad due to the heat, it is preferred that the painted top pad 100 be dried at a temperature of about 180° C. (S6000).

After the ink painted on the top pad 100 has been completely dried, the bottom pad 200 is placed onto a worktable. Then, the flexible printed circuit board 300 and the top pad 100 are sequentially aligned on the bottom pad 200 according to a predetermined vertical arrangement. At this time, first and second contact portions 310 and 320 are formed on the flexible printed circuit board 300 to correspond to the first and second recesses 110*a* and 110*a* formed on the bottom surface of the top pad 100, respectively.

When the keys 110 and 120 of the top pad 100 are pressed down, the relevant recesses 110*a* and 120*a* are pressed down and brought into close contact with the contact portions 310 and 320 which are in turn electrically contacted. Therefore, if the flexible printed circuit board 300 is electrically connected to the controller 2000, a predetermined sound can be produced through a speaker 2200.

These contact portions 310 and 320 are formed to correspond to the shape and location of the recesses 110*a* and 120*a* and electrically connected to a pair of ground portions 330 formed at one side of the flexible printed circuit board 300. The ground portions 330 are received into and electrically connected to the controller 2000.

In a state where the top pad 100, the flexible printed circuit board 300 and the bottom pad 200 are sequentially aligned from below to above as described above, edge portions of the top and bottom pads 100 and 200 are bonded with the silicon liquid rubber.

At this time, the bonding is made between the engaging jaws 130 and 220, between the first fitting portion 140 and the inclined portion 240 and between the bottom surface of longitudinal edges of the top pad 100 and the bottom surface of the bottom pad 200 adjacent to the escape prevention jaw 210. In addition, bonding tips 400 made in the form of a plastic rod are fitted into the through-holes of the engaging jaws 130 and 220, and protruding portions of the tips are then heat bonded. Consequently, the keyboard 1000 is finished.

As described above, since the pads 100 and 200 are formed such that the escape prevention jaws 210 of the bottom pad 200 prevent both longitudinal sides of the top pad 100 from being escaped, the top pad 100 is securely seated between the escape prevention jaws 210. Therefore, the silicon liquid rubber can be prevented from leaking to the outside (S7000).

Referring again to FIGS. 2 to 4, the keyboard 1000 manufactured as described above comprises the rectangular top pad 100 on which the keys 110 and 120 are integrally formed, the bottom pad 200 which is correspondingly engaged with the bottom surface of the top pad 100, and the flexible printed circuit board 300 which is securely interposed between the top and bottom pads 100 and 200. That is, the keyboard 1000 is configured in such a manner that the bottom pad 200, the flexible printed circuit board 300 and the top pad 100 are sequentially stacked one above another and bonded with one another in a vertical direction.

The plurality of the first and second keys 110 and 120, which can cover a 4-octave range, are formed on the top pad 100 in a longitudinal direction. The top pad 100 has a length of about 720 mm, a width of about 170 mm and a thickness of about 2 mm. Further, the first keys 110 are painted with the white ink, whereas the second keys 120 are painted with the block ink. In addition to the keys 110 and 120, the top and bottom pads 100 and 200 also have a predetermined color since they have been already colored with pigments prior to the painting of the keys 110 and 120.

Furthermore, the first engaging jaw 130 and the first fitting portion 140 are formed on the top pad at both sides thereof in a state where the keys 110 and 120 are placed between the jaw 130 and the fitting portion 140. The first engaging jaw 130 is bent upward and then extended horizontally at one side of the top pad 100, and the first fitting portion 140 is shaped to have a thickness growing thicker toward the outermost end thereof. That is, the top surface of the first fitting portion 140 is curved like a stair structure, whereas the bottom surface thereof inclines upward and then extends horizontally.

The bottom pad 200 has a length of about 720 mm same as that of the top pad 100, and a width of about 174 mm wider than that of the top pad. The escape prevention jaws 210 are formed on the extended portion in a longitudinal direction. Further, the second engaging jaw 220 and the second fitting portion 230 are formed at both sides of the bottom pad 200 to correspond to the first engaging jaw 130 and the second fitting portion 140, respectively.

The second engaging jaw 220 is first bent upward and then extended horizontally so that it can come into close contact with the bottom surface of the first engaging jaw 130, whereas the second fitting portion 230 protrudes downward along a lateral direction on the bottom surface of the bottom pad 200. Thus, the top surface of the second side of the bottom pad 200 is formed to incline upward and extend horizontally so that the bottom surface of the first fitting portion 140 can be brought into close contact with the top surface of the inclined portion 240.

Therefore, when the bottom surface of the top pad 100 and the top surface of the bottom pad 200 face each other in conformity with their shapes, the engaging jaws 130 and 220 are correspondingly brought into contact with each other and the inclined portion 240 are brought into close contact with the bottom surface of the first fitting portion 140.

As described above, the flexible printed circuit board 300 is also interposed between the top and bottom pads 100 and 200. A plurality of contact portions 310 and 320 are formed in parallel on the flexible printed circuit board 300 in conformity with the positions and shapes of the keys 110 and 120. The first and second recesses 110*a* and 120*a* are formed on the bottom surface of the top pad 100 to correspond to the contact portions 310 and 320, respectively. The first and second recesses 110*a* and 120*a* are formed by causing peripheral portions thereof to protrude downward and also formed below the keys 110 and 120 in conformity with the shapes and locations of the keys. Accordingly, the first recesses 110*a* are formed below the first keys 110 whereas the second recesses 120*a* are formed below the second keys 120.

Consequently, the keyboard 1000 of the present invention comprises the pads 100 and 200 and the flexible printed circuit board 300 interposed between the pads 100 and 200, and is configured such that the pads 110 and 120 are bonded to each other with an adhesive applied on the edges thereof. If a specific key 110 or 120 and a corresponding specific recess are pressed down, the relevant contact portion is electrically contacted. Further, it is more preferred that the adhesive to be used at this time be the silicon liquid rubber that is the same as the material of the pads 100 and 200.

Figure 5:
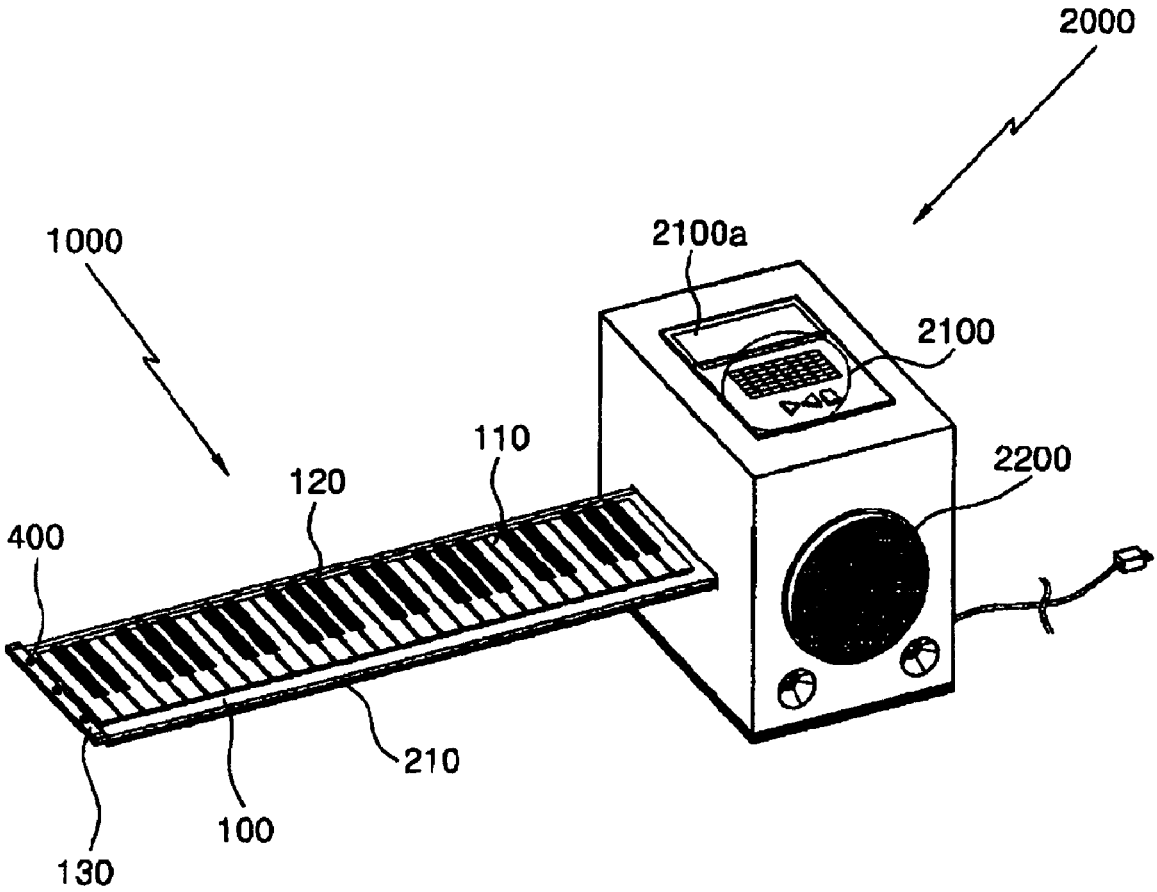
FIG. 5 is a perspective view showing a state of use of the keyboard so manufactured according to the present invention.

FIG. 5 is a perspective view showing a state of use of the keyboard so manufactured according to the present invention. Referring to this figure, if the contact portions are pressed and electrically contacted, predetermined electrical signals are transmitted to the ground portions 330 that are connected to the contact portions 310 and 320 through a circuit and electrically connected to the controller 2000. Thereafter, the electrical signals are also transmitted to the controller 2000 so that the predetermined sounds corresponding to the transmitted signals can be produced through the speaker 2200.

The box-shaped controller 2000 is configured in such a manner that the ground portions 330 of the keyboard 1000 are received therein and electrically connected thereto when upper and lower sections thereof are assembled. An operating key unit 2100 is provided on a top surface of the controller 2000, and a LCD panel 2100*a* is also provided on the top surface of the controller so as to display contents set by the operating key unit 2100 thereon. Further, the speaker 2200 is provided on a front surface of the controller so as to allow the predetermined sounds to radiate.

As described above, the flexible printed circuit board 300 is electrically connected to the controller 2000 and the fitting portions 140 and 230 of the top and bottom pads 100 and 200 are engaged with and fixed to the controller. To this end, the fitting portions 140 and 230 are formed to be relatively thick so that the fixed state can be firmly maintained.

If a user wants to produce a desired sound in a predetermined musical range, the predetermined key should be pressed down so that the bottom surface of the recess comes into close contact with the contact portion. Thus, an electrical signal is transmitted to the controller 2000 via the ground portion 330 and the desired sound can be produced from the speaker 2000.

In the keyboard and method for manufacturing the keyboard according to the present invention, the keyboard can be manufactured to allow the first keys 110 to have the black color and the second keys 120 to have the white color, and the keys can also be pained with a variety of colors to have different colors from each other. Furthermore, the pads 100 and 200 can be used either to have different colors from each other or to have an inherent color of the silicon rubber without adding the pigments to the pads.

Furthermore, the keyboard 1000 may be applied to a variety of keyboard instruments such as the keyboard for children's playing or musical training, the keyboard for use in a piano, an organ, an accordion, an electrical piano and a synthesizer, and the keyboard for playing a pipe organ, if the aforementioned size and the octave range thereof are modified in a various manner. In addition, the keyboard 1000 may be used for exercising children's fingers even though the top and bottom pads 100 and 200 are engaged with each other in a state where the flexible printed circuit board 300 is not fitted into the controller 2000.

Moreover, the present invention can be applied to the manufacture of the pad-type percussion instruments such as a xylophone and a drum, in addition to the keyboard instruments.

It is also possible to manufacture and use a variety of keyboards 1000 under the different manufacturing conditions (in which a mixing ratio of pigments, a kind of printing color, drying temperature and time, an ingredient of the adhesive, and the like can be varied) within the scope of the method for manufacturing the keyboard according to the present invention.

According to the present invention, the press works, the painting works using the printing machine, and the like can be used for manufacturing the keyboard. Thus, there is an advantage in that the keyboard can be produced in a large quantity within a short time.

Further, since the manufactured keyboard is relatively light and small in volume and can be rolled and stored, the mobility and portability thereof can be improved. In addition, since an excessive load is not applied to the user's fingers due to resiliency of the keys, the keyboard can be conveniently used for playing the keyboard instruments for a long while.

Although the present invention has been described in connection with the preferred embodiment with reference to the accompanying drawings, it is apparent to those skilled in the art that various changes or modifications may be made thereto without departing from the spirit and scope of the invention. Therefore, the present invention should be defined only by the appended claims and be construed as covering such changes or modifications.

What is claimed is:

1. A method for manufacturing a keyboard, comprising the steps of:

coloring gel-state silicon rubber by mixing pigments with the silicon rubber;

rolling the colored silicon rubber into a plurality of sheets with a predetermined thickness;

forming a top pad by press working the sheet such that a plurality of keys are arranged on a top surface of the top pad and a plurality of recesses are formed on a bottom surface thereof to correspond to the keys in view of their shapes and location, wherein a first engaging jaw is formed by upward bending and horizontally extending a first end of the top pad;

forming a bottom pad by press working the sheet such that the bottom pad has a shape corresponding to the bottom surface of the top pad and a width of the bottom pad is further increased, wherein a second engaging jaw is formed by upward bending and horizontally extending a first end of the bottom pad such that the second jaw is brought into close contact with a bottom surface of the first combining jaw;

painting surfaces of the keys through a silk-screen printing method;

heating the painted top pad at a temperature of 180 for 10 minutes and drying ink painted on the top pad; and aligning the bottom pad and a flexible printed circuit board with electrical contact portions formed thereon corresponding to the recesses with respect to the bottom surface of the top pad and bonding corresponding edges of the top and bottom pads to finish the keyboard.

2. The method as claimed in claim 1, wherein the step for forming the bottom pad comprises the step of forming escape prevention jaws having a relatively narrow width and long length in a longitudinal direction along portions extending widthwise further than the top pad.

3. The method as claimed in claim 1, wherein silicon liquid rubber is used as an adhesive in the step.

4. The method as claimed in claim 1, wherein the stop for forming the top pad comprises the step of forming a first fitting portion, which grows thicker toward an outermost end, on a second end of the top pad.

5. The method as claimed in claim 4, wherein the step for forming the bottom pad comprises the step of forming a second fitting portion, which corresponds to the first fitting portion and protrudes downward in a certain length along a lateral direction, at a second end on a bottom surface of the bottom pad.

6. A keyboard, comprising;

a top pad with a plurality of first keys and second keys integrally formed and arranged on a top surface thereof, wherein the top pad further includes a first engaging jaw formed by upward bending and horizontally extending a first end thereof;

a bottom pad of which width is relatively extended and of which top surface corresponds to a bottom surface of the top pad in view of their shapes such that edges of the top and bottom pads are bonded to each other, wherein the bottom pad further includes a second engaging jaw formed by upward bending and horizontally extending a first end thereof to come into close contact with a bottom surface of the first combining jaw; and a flexible printed circuit board which is interposed between the top and bottom pads, sealed therebetween by bonding the edges of the top an bottom pads, and formed with contact portions corresponding to the keys, wherein first and second recesses are formed on the bottom surface of the top pad to correspond to the first and second keys and the contact portions of the flexible printed circuit board in view of their shapes and locations, and the top and bottom pads and the keys are made from silicon rubber material and are colored with pigments and painted with inks to give predetermined colors to the pads.

7. The keyboard as claimed in claim 6, wherein the bottom pad further includes escape prevention jaws formed along extended portions of the bottom pad in a longitudinal direction to have a relatively narrow width and long length.

8. The keyboard as claimed in claim 6, wherein the pad further includes a first fitting portion, which grows thicker toward an outermost end, or a second end thereof.

9. A The keyboard as claimed in claim 8, wherein the bottom pad further includes a second fitting portion, which corresponds to the first fitting portion and protrudes downward in a certain thickness along a lateral direction, at a second end on a bottom surface thereof.

10. The keyboard as claimed in claim 6, wherein the top and bottom pads are bonded to each other using silicon liquid rubber as an adhesive.

* * * * *